United States Patent [19]

Stahovec

[11] 4,300,116

[45] Nov. 10, 1981

[54] SAFETY METHOD AND APPARATUS FOR SENSING THE PRESENCE OF INDIVIDUALS ADJACENT A VEHICLE

[76] Inventor: Joseph L. Stahovec, 35 Brundage St., Springdale, Conn. 06907

[21] Appl. No.: 103,412

[22] Filed: Dec. 13, 1979

[51] Int. Cl.[3] ..... G08G 1/01; G08B 13/26; H01Q 1/32

[52] U.S. Cl. ..... 340/32; 340/31 R; 340/38 R; 340/562; 340/563; 343/715; 343/717; 343/841

[58] Field of Search ..... 340/38 R, 32, 31 R, 340/561, 562–564; 343/711, 713, 715–717, 789, 841, 872, 767; 361/303, 304; 333/24 C, 239, 242, 243

[56] References Cited

U.S. PATENT DOCUMENTS

| | | | |
|---|---|---|---|
| 3,445,835 | 5/1969 | Fudaley | 340/38 R |
| 3,732,555 | 5/1973 | Strenglein | 340/32 |
| 3,842,397 | 10/1974 | Sindle | 340/32 |
| 4,047,166 | 9/1977 | Miller et al. | 340/38 R |

FOREIGN PATENT DOCUMENTS

| | | | |
|---|---|---|---|
| 1255098 | 10/1965 | France | 340/564 |

*Primary Examiner*—James J. Groody
*Attorney, Agent, or Firm*—Frank J. Thompson

[57] ABSTRACT

An improved safety method and apparatus for sensing individuals adjacent a vehicle utilizes a balanced bridge circuit. The method and apparatus provides for rebalancing the bridge circuit at a first rate during vehicle motion to compensate for topography and environmental changes as the vehicle proceeds and for varying the rate to a second relatively lower rate, and, alternatively inhibiting rebalancing of the bridge circuit when the vehicle is stationary during proximity detection of individuals adjacent the vehicle. A delay in restoring the rebalancing rate to the first rate is provided as the vehicle prepares to proceed. An improved electrode, detection assembly employed in the method and apparatus is described.

20 Claims, 7 Drawing Figures

SAFETY METHOD AND APPARATUS FOR SENSING THE PRESENCE OF INDIVIDUALS ADJACENT A VEHICLE

BACKGROUND OF THE INVENTION

1. Field of the Invention

This invention relates to a method and apparatus for indicating the presence of an individual adjacent to a vehicle which is about to be placed in motion. The invention relates more particularly to a safety method and apparatus which will indicate to a vehicle operator the dangerous proximity of a person adjacent the vehicle.

2. Background of the Invention

The need often arises for indicating to the operator of a vehicle the presence of an individual in an area about the vehicle and which presence constitutes a hazard to the safety of the individual as the vehicle is placed in motion. Such vehicles are characterized by a limited, restricted visibility and include an area which cannot be adequately viewed by the vehicle operator from his station prior to initiating vehicle motion. While backing vehicles are generally recognized to have areas obscured to the operator directly rearward of the vehicle, limited areas forward of the vehicle can also be obscured to the operator.

Restricted visibility is particularly important with respect to school buses which transport young children who are exposed daily to a potential hazard resulting from obscured operator viewing. While various precautions have been taken in the operation of school buses, the physical size of grade school children, the restricted operator viewing and a propensity for young children to quickly dart into an obscured area of the bus unknowing to the operator have all contributed to fatalities in the operation of school buses. It is found that the forward portions of some school buses obstruct the operator's view of the ground area immediately in front of the vehicle for a distance of several feet. Children have been known to alight from a bus, traverse this area, and suddenly and unknown to the operator, dart back in front of the bus at times resulting in fatalities.

Various means have been provided in order to aid the operator in sensing the presence of individuals about the vehicles. One well known technique provides for an array of mirrors which are oriented for operator viewing of a normally obscured area. While reflector systems of this type have operated satisfactorily to a limited extent, a safety system relying solely on reflective mirrors suffers from the important defect that at times the operator will, for various reasons, fail to tuilize this viewing system, or at times, the operator's attention is momentarily diverted at a critical moment from this viewing task by surrounding circumstances. In the case of school buses, such distraction is frequently caused by the activity and movement of children about the interior of the bus. The importance of safety with respect to operation of school buses and the potential fatalities which can arise has resulted in augmenting the school bus operator's viewing system with a monitor adult rider whose sole purpose is to verify clearance of persons about the bus prior to initiating motion. This approach not only substantially increases the cost of operating a school bus, but the technique fails when the adult monitor rider, for various reasons, is unable to attend to this task. Additionally, in order to restrict passage of children through a blind area forward of the bus, several mechanical means comprising extensible, elongated rods have been provided which rotate outwardly from a retracted position of the bus. Upon extension, the rods restrict children from passing through the blind area in front of the bus. These rods, while effective to a large extent, can be and have been defeated by playful and persevering children.

Capacitive proximity detectors are known and have been utilized in various sensing applications. These detectors generally include a capacitance which is formed between a stationary electrode and earth ground and which capacitance is included as an arm of a balanced bridge circuit. The movement of an object into an electric field existing between the electrode and earth ground, or, the departure of an object from the area, alters the capacitance, unbalances the bridge and a resulting indication is provided. While capacitive proximity detectors are used as stationary detectors, their usefulness with vehicles which repeatedly travel from one location to another and which experience continuous road variations and varying environmental conditions have heretofore been impractical as a vehicle safety device for sensing the proximity of individuals adjacent the vehicle. Moreover, various factors including relatively rapid ingress and egress of parties to the area of the electric field, a variation in capacitance caused by different environmental factors surrounding a stationary vehicle such as rocking and deflecting of the vehicle by parties boarding and disembarking the vehicle, movement of objects within the field during a pause of the vehicle at a location and other conditions including rain, snow, ice and dirt accumulations on an external electrode, all contribute to rendering the capacitance type of bridge circuit susceptible to repeated false indications.

It would be beneficial to provide a capacitive proximity detector for use on a vehicle which is relatively stable in operation and which reduces susceptibility to false indications.

SUMMARY OF THE INVENTION

Accordingly, it is an object of this invention to provide an improved safety method and apparatus for sensing and indicating the presence of an individual adjacent to a vehicle which is to be placed in motion.

Another object of the invention is to provide an improved form of capacitive, proximity detector apparatus for use as a safety device in sensing and indicating the presence of individuals adjacent a vehicle which is to be placed in motion.

Another object of the invention is to provide for a vehicle a proximity safety apparatus of the capacitive arm, balanced bridge type and having means for rapidly rebalancing a bridge circuit as the vehicle moves from location to location.

A further object of the invention is to provide a capacitive arm, balanced bridge proximity detector for use as a safety apparatus with a vehicle and which can be rapidly rebalanced to accommodate changes in environmental conditions while at the same time indicating the presence of an individual in a hazard area of the vehicle at a stationary location.

Another object of the invention is to provide a capacitive, balanced bridge safety apparatus of the type described and which is adapted to rebalance the bridge circuit in accordance with environmental conditions at a stationary location while enabling the apparatus to sense and indicate entry of an individual into a hazard area of the vehicle.

A proximity detector for a vehicle includes an initially balanced bridge-circuit having a capacitor formed between earth ground and an electrode which is mounted to the exterior of the vehicle. Entry of a body into an electric field of the capacitor causes a change in capacitance $C_d$ which unbalances the initially balanced bridge circuit. The bridge circuit also becomes unbalanced when other physical and environmental variations occur which are not attributable to entry of a body into the field and which alter the capacitance $C_d$.

Another object of the invention is to provide for rebalancing the bridge circuit as it becomes unbalanced due to environment and physical factors and changes in the physical characteristics of electrical circuit components while, at the same time, discriminating between these variations and a variation caused by the entry of a person into the field.

A further object of the invention is to provide a capacitive type, balanced bridge-circuit, proximity detector for use with a vehicle as a safety apparatus and having means for delaying rebalancing of the bridge circuit at a first, relatively rapid rate prior to, and, upon initiation of motion of the vehicle.

Another object of the invention is to provide an improved, stable, circuit arrangement for a capacitive type balanced bride-circuit, proximity detector for use as a safety apparatus with a vehicle.

Still another object of the invention is to provide an improved electrode assembly for a proximity detector for a vehicle.

The method of the invention comprises the steps of establishing an electric field between an electrode and earth ground in an area exterior to a vehicle, automatically sensing bridge circuit unbalance, rebalancing the bridge circuit at a first rate when the vehicle is in motion to compensate for factors causing bridge unbalance, varying the rate at which the bridge circuit is rebalanced when the vehicle is stationary to compensate for factors causing bridge circuit unbalance, detecting a change in the capacitance $C_d$ existing between electrode and ground earth accompanying the entry of a body into the external field when vehicle is stationary, generating a sensory indication for a vehicle operator when the bridge circuit becomes unbalanced, and rebalancing the bridge circuit at the first rate upon movement of the vehicle.

More particular features of the method of the invention provide for varying the bridge circuit rebalancing rate to a second lower rate, and, alternatively inhibiting rebalancing when the vehicle become stationary in order to enhance detection of a change in the capacitance $C_d$ which accompanies relatively rapid entry of a body into the electric field area. Bridge circuit rebalancing at the second relatively lower rate is provided to compensate both for factors causing a change in the capacitance $C_d$ which are not attributed to entry of a body into the electric field area, and, for variations in electrical circuit component characteristics. Rebalancing at the second rate is inhibited upon entry of a body into the field of a stationary vehicle. In accordance with other more particular features of the invention, changing the bridge circuit rebalancing rate to the first rate is delayed for an interval of time $T_d$, as the vehicle is conditioned for proceeding in motion, in order to enable detection of a relatively late entry of a body into the electric field area at a time immediately proceeding or upon initiation of vehicle motion. Other features of the method of the invention provide for enabling an audible or visual sensory indication when the vehicle is stationary and during the delay interval $T_d$.

In accordance with features of the apparatus of the invention, a vehicle safety detector and indicator for detecting and indicating the proximity of a person adjacent the vehicle includes a balanced bridge circuit means having a capacitor of capacitance $C_d$ which is formed between an electrode mounted exterior to the vehicle and earth ground. A circuit means is coupled to the bridge circuit for electrically exciting the circuit and establishing an electric field exterior to the vehicle between the electrode and earth ground. Circuit means are provided for sensing an imbalance in the bridge circuit. A circuit means responsive to electrical imbalance of the circuit is provided for automatically rebalancing the bridge circuit at a first rate when the vehicle is in motion and for varying the rate at which the bridge circuit is rebalanced when the vehicle is stationary. Circuit means detect a variation in the capacitance $C_d$ accompanying the entry of a body into the electric field area and circuit means responsive to such entry generate a sensory indication for a vehicle operator. Circuit means are also provided for rebalancing the bridge circuit at the first rate upon movmement of the vehicle.

In accordance with other features of the apparatus of the invention, the circuit means for varying the rebalancing rate when the vehicle is stationary varies the rebalancing rate to a second lower rate, and, alternatively inhibits rebalancing of the bridge circuit during the interval the vehicle is stationary. Circuit means inhibit rebalancing at a second rate upon entry of a body into the electric field when the vehicle is stationary. Other features of the invention include means for delaying rebalancing of the bridge circuit at the first rate prior to motion of the vehicle and for an interval thereafter in order to alert the operator to the late entry of an object into the field immediately prior to and shortly after movement of the vehicle. Circuit means are also provided for enabling audible and visual sensory indications when the vehicle is stationary and during the delay interval $T_d$.

An electrode assembly in accordance with features of the invention comprises an elongated, electrically conductive, guard body extending in the direction of its longitudinal axis and having a semicircular cross sectional configuration. The guard body includes an arcuate gap in the cross sectional configuration. An electrode body comprises an elongated strip formed of electrically conductive material which is positioned in the arcuate gap and is spaced apart from the guard body. This strip extends substantially coextensively with the guard body. An insulating means is positioned about the first and second bodies and extends coextensively therewith. Means for mounting the electrode assembly to a surface of a vehicle is provided. In a particular embodiment, the guard and electrode bodies are supported on an elongated tubular body of electrically insulating material and the electrode assembly is mounted to a lower surface of the vehicle. The guard and electrode bodies are relatively orientated for establishing an electrostatic field extending downwardly from the mounting surface and outwardly from the vehicle.

BRIEF DESCRIPTION OF THE DRAWINGS

These and other objects and features of the invention will become apparent with reference to the following specification and to the drawings wherein.

DETAILED DESCRIPTION

Figure 1:
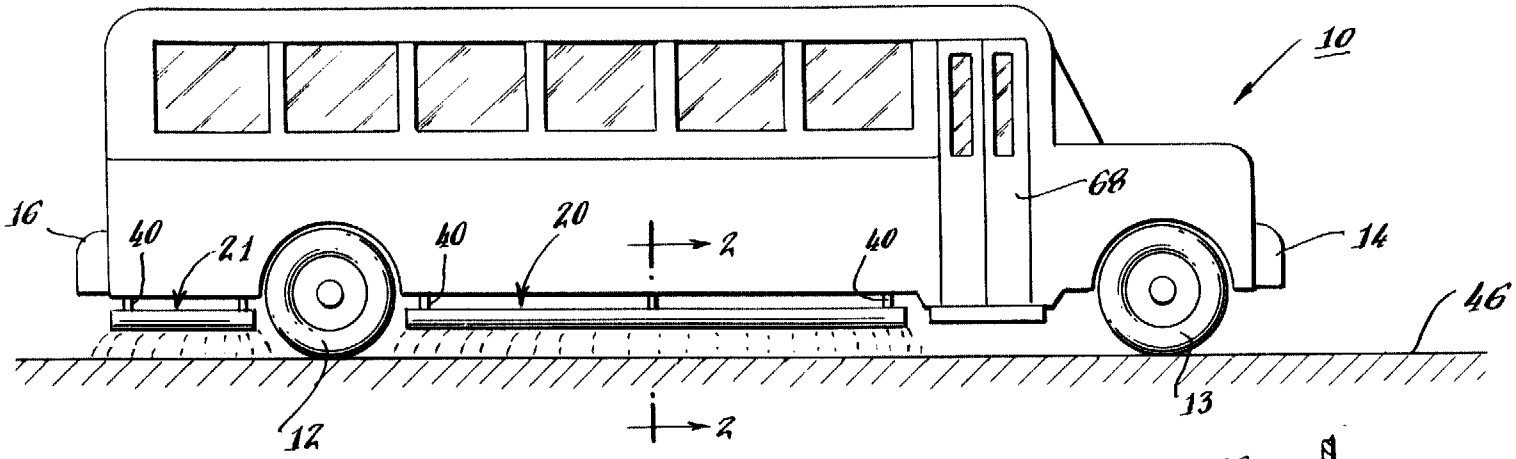
FIG. 1 is a side elevation view of a vehicle utilizing an embodiment of the invention.

Referring now to the drawings and particularly to FIG. 1 there is illustrated a vehicle having a safety apparatus constructed in accordance with the invention for alerting the operator of the vehicle to the presence of individuals adjacent the vehicle prior to movement of the vehicle. The apparatus is particularly useful with the vehicle 10 shown to comprise a school bus since the potential hazard to young school children when the operator's vision is obstructed as the bus initiates movement is known. In particular, the danger areas with respect to the school bus 10 include the area immediately forward of the rear wheels 12, the area immediately forward of the front wheels 13 and the bumper 14, and the area rearward of the rear bumper 16. It is in these locations that children are often not seen as the bus proceeds and it is at these locations that injuries can and do occur. In addition to the school bus 10 of FIG. 1, the invention is equally applicable with respect to other vehicles, particularly vehicles about which children may congregate, such as ice cream vendor vehicles and like vehicles. A beneficial use of the invention can also be made with other vehicles including construction equipment, delivery trucks, vans and automobiles.

Figure 2:
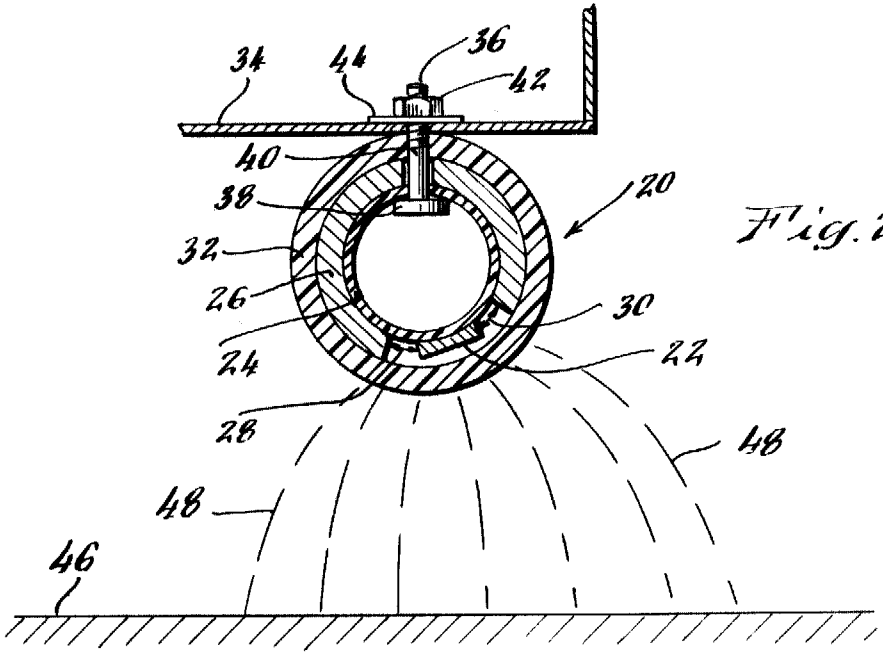
FIG. 2 is an enlarged, fragmentary view, partly in section, taken along lines 2—2 of FIG. 1 and illustrating an electrode assembly and electric field.

An electrode assembly 20 is mounted to the bus 10 immediately forward of the rear wheels 12. A similar electrode assembly 21 is mounted rearward of the rear wheels. As best seen in FIG. 2, electrode assembly 20 comprises an elongated, metalic strip electrode body 22 which is mounted to the bus 10 and which extends in a longitudinal direction immediately forward of the rear wheels 12. Electrode body 22 is mounted to an elongated tubular, plastic support body 24 by an adhesive such as an epoxy resin or other suitable means. Extending about the tube 24 is an electrode guard body 26 formed by an elongated metal body and which has a semicircular cross sectional configuration extending for an arcuate distance about the tube 24. The electrode 22 is positioned in an arcuate interstice and is spaced from the guard body 26 by air gaps 28 and 30. The guard body 26 is supported on the tube 24 and is mounted thereto by a suitable adhesive. The assembly of the electrode body 22, the tubular support body 24 and the guard body 26 is enclosed in an outer tubular body 32 for shielding the assembly from deposits of dirt and foreign matter which can undesirably form a conductive path, or alter the effective electrical length of the paths 28 and 30, between the electrode body 22 and the guard body 26. The outer tube 32 is formed of a nonmetalic, weather resistent material such as a polymer plastic formed as an integral body. Alternatively, the assembly of the bodies 22, 24 and 26 are dipped or coated with such material. This elongated electrode assembly is supported from a floor or frame member 34 of the vehicle 10 by a stud 36 having a head segment 38 which engages an inner surface of the electrically insulated tubular body 24. A body segment 40 of the stud extends through the electrode assembly 20, through an aperture in the member 34 and a threaded segment thereof engages a locknut 42 which is spaced from the floor segment 34 by a washer 44.

As is indicated hereinafter, the electrode 22 comprises an electrode element of a capacitor which is coupled as an arm of a balanced bridge circuit. Another electrode of this capacitor is provided by earth ground immediately adjacent the electrode assembly 20. This capacitor has a capacitance $C_d$. As illustrated in FIGS. 1 and 2, the earth ground is shown as the road surface 46 but it will include curbs, steps and other forms of topography which is spaced from the vehicle 10 adjacent the electrode assembly. The balanced bridge circuit described hereinafter, is electrically excited and an electrostatic field is established between the electrodes of this capacitor. The general configuration of this electrostatic field and its extension from the electrode body 22 over an area adjacent the vehicle is illustrated in FIGS. 1 and 2 by the dashed lines 48. The electrode assembly 21 is similarly constructed and generates a similar electric field.

The electrode assembly configuration 20 operates to cause an electrical field to extend outwardly from beneath the bus. Variations occur in the magnitude of the capacitance $C_d$ resulting from such factors as changes in the topography, environmental conditions, motion, etc. In addition, the field extends downward and outwardly a distance from the vehicle for providing that a person standing adjacent the vehicle will be positioned in the field or the fringe area of the field. The presence of a person or an object in the field will alter the field from an initially established pattern and thereby vary the capacitance $C_d$ between the electrode 22 and earth ground. A variation in capacitance resulting from entry of a person or object into the field will cause an initially balanced bridge, as discussed hereinafter, to become unbalanced and will initiate an indication of the presence of the person or object in this area.

An electrode assembly, not illustrated, similar to electrode assembly 20, is also positioned on an opposite side of the bus immediately forward of the rear wheels for establishing an electrostatic field in the vicinity. Other similar electrode assemblies may be positioned adjacent the forward and rearward bumpers 14 and 16 respectively.

Figure 3:
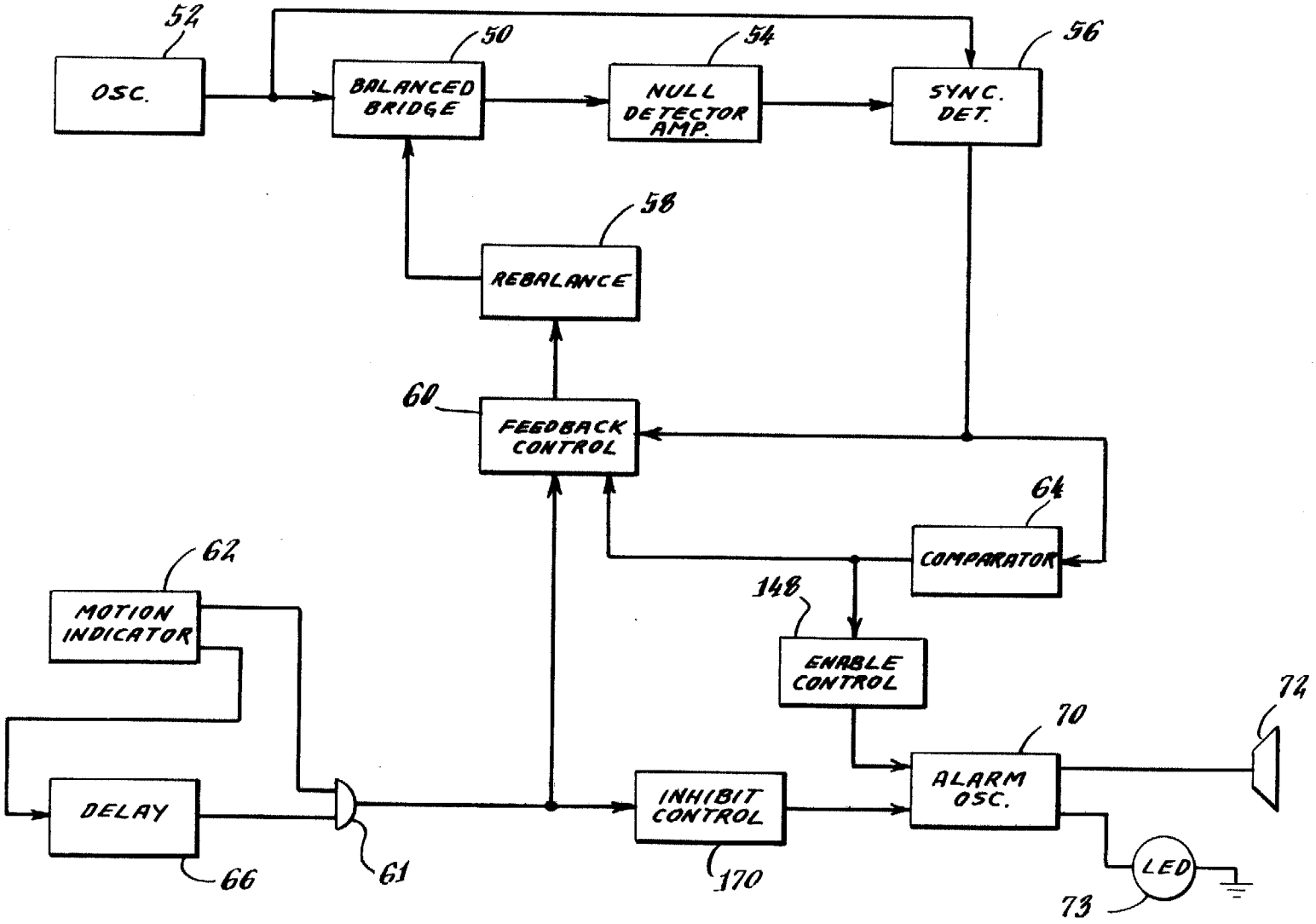
FIG. 3 is a block diagram of a circuit arrangement of the apparatus of this invention.

A circuit arrangement for use with the electrode assembly 20 is illustrated in the block diagram of FIG. 3 and is shown to include a balanced bridge circuit means 50, and oscillator circuit mens 52 for exciting the bridge, a null detector amplifier circuit means 54, the output of which is applied to a synchronous detector circuit means 56, along with an output from the oscillator 52. A feedback circuit means including a rebalancing circuit means 58 and feedback control circuit means 60 is provided and is coupled between balanced bridge 50 and the synchronous detector 56 and a comparator 64. When the bridge 50 exhibits an unbalanced condition, as for example when the vehicle transits from place to place and capacitance $C_d$ varies, the balance detector null circuit means 54 senses the unbalanced condition and provides an output voltage to the synchronous detector 56. The input to the synchronous detector 56 from the amplifier 54 is an alternating signal having a phase which varies relative to the phase of an alternating signal applied to the synchronous detector 56 from the oscillator 52. The sense and magnitude of the phase variation is detected by the synchronous detector 56 and an output voltage is applied to the feedback circuit means for restoring the bridge to a balanced condition.

As the vehicle 10 proceeds from location to location, the topography of the earth over which it travels varies; the capacitance $C_d$ between the electrode member 22 and the earth ground will vary; and, the synchronous detector 56 will continuously generate corrective voltage for restoring the bridge to a balanced condition. In addition to variations in topography, the capacitance $C_d$ will vary because of such factors as accumulation of dirt, snow, ice, etc. on the electrode assembly 20 and because of movement, deflection and bouncing of the assembly as the vehicle proceeds. The feedback control 60 provides a relatively short time constant $T_1$ for rebalancing of the bridge circuit during vehicle motion at a first relatively rapid rate so that when the vehicle comes to a stop at a desired location, the bridge circuit will be balanced at that location.

Although a continuous rebalancing of the bridge circuit at the first relatively rapid rate is desirable during vehicle motion in order to provide a balanced circuit and thus condition the circuit for detection at a new locale as the vehicle stops, upon stopping it is desirable to vary the rate of rebalancing in order to enable the circuit to discriminate between the rapid entry of an individual into the field and other rapid changes attributable to other factors. A circuit means for varying the rebalancing is provided and comprises the feedback control circuit means 60 and control inputs thereto. Inputs to the feedback control circuit means 60 are derived from an OR gate 61, from a comparator circuit means 64 and from the synchronous detector 56. Inputs to the OR gate 61 are derived from a vehicle motion indicator 62 and a delay circuit 66. The motion indicator 62 comprises a switch which is operably coupled to the vehicle door 68 (FIG. 1). The vehicle door will be opened when the vehicle stops. Opening of the vehicle door 68 actuates a switch 126 (FIG. 4) and applies a control voltage to the feedback control circuit means 60 via the OR gate 61 causing the feedback control circuit 60 to vary the rebalancing rate or alternatively to inhibit rebalancing. Alternative motion detectors may be utilized, as for example a sensor coupled to the vehicle transmission or differential which senses physical motion of the vehicle and applies a control voltage to the circuit means 60.

Variations in rebalancing rates, as described hereinafter, are accomplished with circuits exhibiting time constants and the rebalancing rates are referred to in terms of these time constants. The first and second rebalancing rates are indicated by the time constants $T_1$ and $T_2$ respectively. The time constant $T_1$ for the first rate is sufficiently short so as to enable rapid rebalancing of the bridge circuit. In one arrangement not limiting the invention in any respect, the time constant $T_1$ is selected to be about 0.5 seconds. The relatively short first rate enables rebalancing to occur responsive to relative rapid changes in $C_d$ occuring during movement of the vehicle thus providing a balanced bridge conditioned for detection as the vehicle stops. However, rebalancing at this rate inhibits discrimination between the relatively rapid changes in $C_d$ caused by a variation in a topographical or environmental factor on the one hand and rapid entry of an individual into the field area on the other. In one embodiment of the invention, rebalancing of the bridge circuit is varied to the second relatively longer rate when the vehicle is stationary. The feedback control 60 enables rebalancing of the circuit at the second rate to accommodate various factors including environmental changes, physical variations which may occur at a particular location after initial rebalancing and to enable the feedback circuit to compensate for variations in the characteristics of circuit components. The second rate of rebalancing is selected to be sufficiently low so as not to respond to relatively rapid changes in $C_d$ caused by entry of a body into the field area. Time constant $T_2$ is selected to be greater than about 30 seconds and preferably about 45 seconds.

The comparator 64 generates an electrical signal representative of the entry of a person or object into the electric field area. When the vehicle is stationary, a signal from the comparator 64 representative of entry of a body into the field area, inhibits continued rebalancing at the second rate. In order to avoid rebalancing when this occurs a comparator output causes the feedback control 60 to inhibit rebalancing of the bridge circuit for an interval of time $T_3$ during such time as the person or object remains in the electric field area. The interval $T_3$ is preferably about 4 minutes. This inhibiting comparator signal is automatically terminated as the object or person exits the field area.

When the vehicle is conditioned for motion and the door 68 is closed, the motion indicator would enable the feedback control to cause rebalancing the bridge circuit at the first rate. However, it is desirable to inhibit rebalancing at the first rate during the interval when the vehicle prepares for and initiates motion. At times, a person or object may make a late entry into the electric field area after preparation for and upon initial movement of the vehicle. This represents a hazard condition and in order to sense this condition, the delay circuit 66 is provided which causes the feedback control 60 to continue to rebalance at the second rate for a delay interval. The delay interval $T_4$ is commensurate with the characteristics of the vehicle but in a preferred arrangement for use with a school bus, this delay is in the range of about 5 to 15 seconds.

A circuit means responsive to an unbalanced bridge circuit condition for detecting the entry of a person or object into the electric field area and for providing a sensory indication to the vehicle operator comprises the comparator 64, an alarm oscillator enable circuit 148, an alarm oscillator 70, and a horn 72 which is excited by the oscillator 70 to provide an audible indication. A visual indication is provided by a light emitting diode 73. As indicated hereinafter, the comparator 64 senses the polarity of a variation in the output voltage of the synchronous detector 56 in excess of a predetermined magnitude which is representative of an unbalanced bridge condition associated with the entry of a person or object into the electric field area after the vehicle comes to a stop. The comparator 64 through enabling circuit 148, enables the alarm oscillator 70 causing an audible and visual indication. The comparator signal also causes the feedback control 60 to inhibit rebalancing of the bridge circuit as indicated for a predetermined interval of time $T_3$. Outputs from the motion indicator 62 and delay 66 provide for enabling of the audible and visual indicator via inhibit control circuit means 170 upon bridge unbalance.

Figure 4:
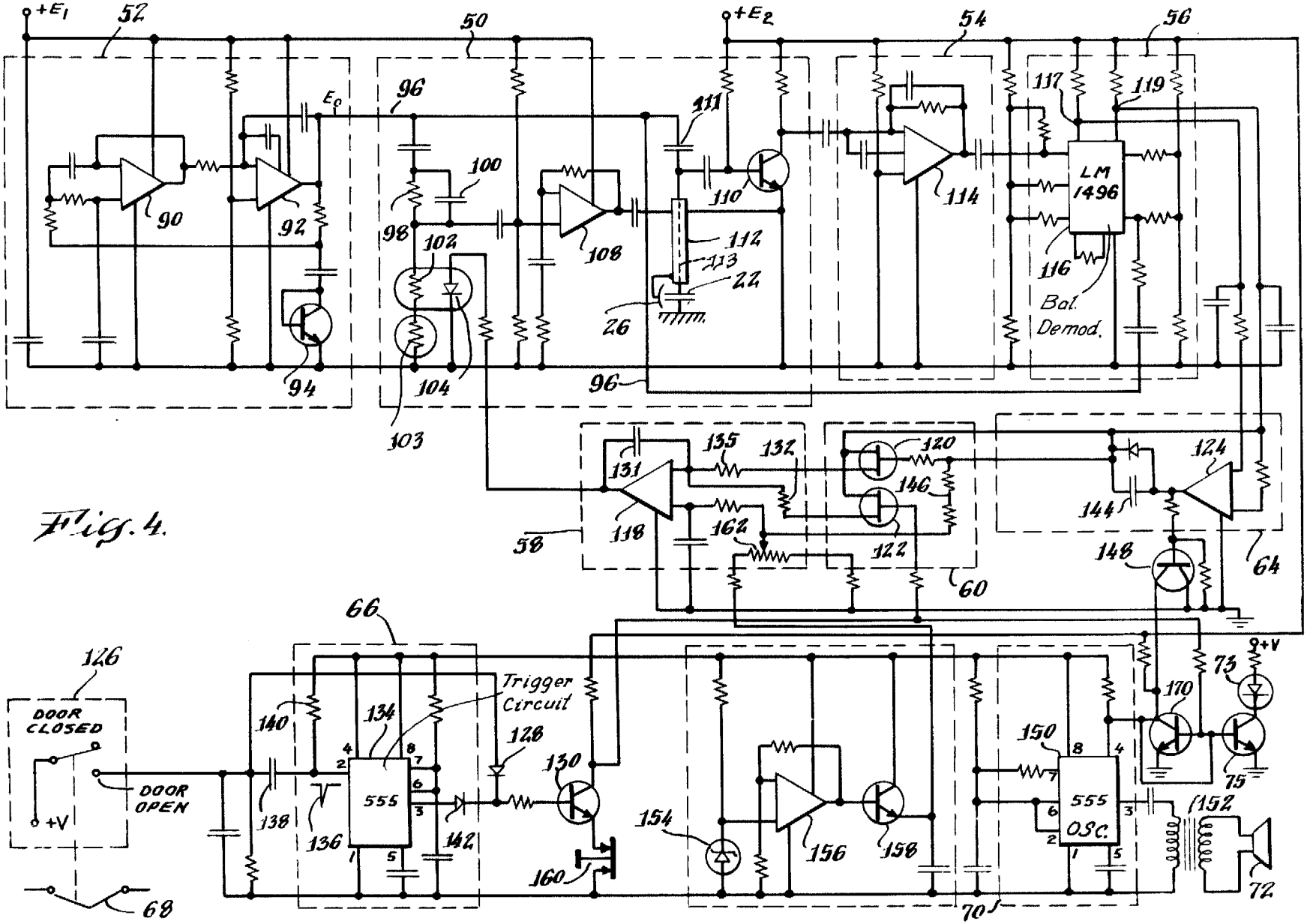
FIG. 4 is a schematic diagram of one embodiment of a circuit arrangement of the apparatus of the invention.

FIG. 4 is a schematic diagram of the circuit arrangement of FIG. 3. Those circuit elements shown in block form in FIG. 3 are shown in dashed outline in FIG. 4 and bear the same reference numerals. The use of the same reference numerals in differing figures refers to the same components performing the same functions. The oscillator 52 comprises a two pole, low-pass active filter 90 and an integrator 92 connected in a positive feedback loop. A clipper circuit 94 clamps the feedback voltage in order to provide amplitude stabilization. The oscillator alternating output voltage ($E_o$) which is at a frequency of approximately 100 KHz is applied to the balanced bridge circuit 50 and to the synchronous detector 56 over a line 96.

Figure 7:
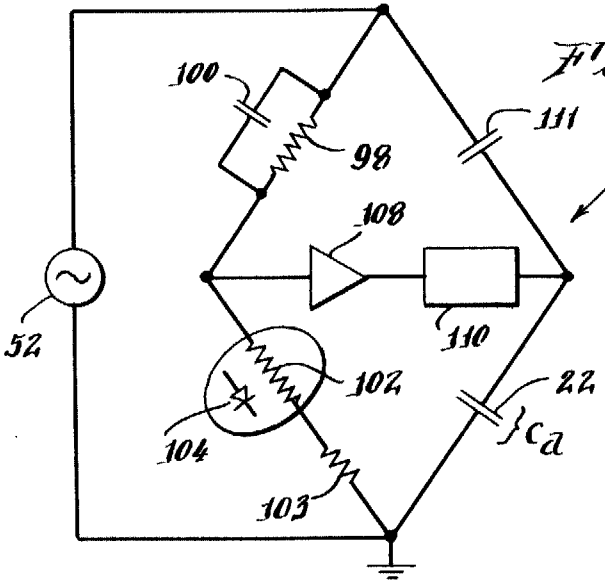

The balanced bridge circuit 50 is a capacitance bridge having a reference voltage side formed by a voltage divider including a fixed resistance 98 which is shunted by a capacitor 100 and an active light control resistance 102 in series with a thermister 103. Resistance 102 has a magnitude which is controlled by a light emitting diode 104. The resistance 102 thus comprises a variable resistance which is varied by a feedback circuit. The feedback circuit excites the light emitting diode 104 in order to adjust the bridge and automatically maintain the bridge balanced. An output of the voltage divider is coupled to a voltage follower amplifier 108. The amplifier 108 is coupled to, and drives the emitter of a differential null detector 110 and a sensor cable shield 112 which is coupled to the externally mounted sensor guard electrode 26 (FIG. 2). The capacitive side of the bridge is provided by a capacitor 111 which is coupled via the conductive wire 113 of the cable to the externally positioned electrode 22. FIG. 7 is a simplified diagram illustrating the bridge circuit arrangement of FIG. 4.

An output of the null detector 110 is applied to the null detector amplifier 54 for additional null signal amplification by amplifier 114. The output of null detector amplifier 114 is applied to the synchronous detector 56. An amplified bridge output signal is synchronously detected by an integrated, balanced demodulator 116 of the demodulator 56. Inputs to the demodulator 56 are the output signal ($E_o$) from the oscillator 52 and the output of the null detector amplifier 114. The synchronous detector 116 provides a DC output at terminals 117 and 119 having a polarity corresponding to an increase or decrease of the sensor electrode capacitance to ground and a magnitude proportional to the magnitude of the bridge unbalance.

An output of the demodulator 56 is coupled to the feedback control 60 and to the comparator 64. The rebalance circuit 58 comprises an operational amplifier 118 coupled as an integrator and having an output thereof coupled to the light emitting diode 104 of the bridge circuit 50. Feedback control circuit 60 is provided by field effect transistors 120 and 122. The comparator circuit 64 is provided by an amplifier 124 coupled as a comparator switch. Motion indicator 62 is provided by the mechanically actuated door switch 126 which is coupled to a source of electric potential (+V). When the switch 126 indicates the door is open, the potential (+V) is applied via a diode 128 of OR gate 61 and a transistor amplifier 130 to a gate electrode of the FET 122 of the feedback control circuit 60. The FET 122 is thus cut off inhibiting rebalancing of the circuit at a first relatively rapid rate. Rebalancing will occur at the second lower rate since the integrator 118 has a relatively long time constant $T_2$ for responding to inputs from terminal 119 of detector 116 through FET 120. The time constant $T_2$ is determined by the integrator capacitor 131 and a resistance 135 in the drain electrode of the conducting FET 120. The interval of time $T_2$ is selected to be greater than about 45 seconds. When the switch 126 is actuated to a position indicating the vehicle door 68 is closed, the FET 122 again becomes conductive and the integrator amplifier 118 has a relatively rapid time constant $T_1$ for responding to an input applied thereto from terminal 119 of the detector 116 through the FET 122 at the first relatively rapid rate. $T_1$ is determined principally by the integrator feedback capacitor 131 and a resistor 132. The time constant $T_1$ is selected to be on the order of about 0.5 second.

The delay circuit 66 is provided by an integrated, digital trigger circuit having a 5 second period. The circuit 134 is triggered by a pulse 136 generated by an RC differentiating network including a capacitor 138 and a resistor 140. An output potential is applied to a diode 142 of the OR circuit 61 for a desired interval of time $T_4$. This diode potential is coupled to the transistor 130 which holds the FET 122 in a cutoff state for the time interval $T_4$. Thus, door closure causes continued cutoff of FET 122 for the interval $T_4$ thereby delaying restoration of the rebalancing rate to the first rate.

Comparator 124 comprises a voltage comparator which switches output voltage when the capacitance bridge is unbalanced by an increase in sensor electrode capacitance. Upon switching, a negative voltage at the comparator output is applied through a capacitor 144 to the gate electrode of the FET 120 driving it to a cutoff state. The input to the integrator 118 is thereby effectively open for an interval of time $T_3$ determined by the time constant of the capacitor 144 and resistances 146. This time constant $T_3$ is chosen to be sufficiently long and preferably on the order of about 4 minutes to assure that the bridge circuit rebalancing is inhibited during the interval $T_3$ during which a person is detected in the electric field area. After expiration of this time interval $T_3$, the FET 120 conducts and automatic rebalancing of the bridge circuit at the second rate will occur. If at any time before the expiration of this interval the person moves out of the electric field area, the output of the comparator 124 will switch to its initial state thereby enabling the gate electrode of FET 120 and reenabling this input to the circuit 60.

An output of the comparator 124 is coupled to alarm oscillator enable control 148 comprising a transistor voltage inverter for controlling a reset input of an integrated circuit oscillator 150 of the alarm oscillator 70. Integrated circuit 150 is coupled as an astable oscillator. When the output of the comparator 124 corresponds to a bridge circuit unbalance, the transistor amplifier 148 becomes nonconductive enabling operation of the oscillator 150. The output of this oscillator, which is at a frequency of about 3,000 Hz, is applied to the horn 72 via an output transformer 152. LED 73 is energized via amplifier switch 75. The audible sound of the horn 72 and the visual indication of the LED 73 alerts the vehicle operator to the presence of a person or object in the electric field area.

During motion of the vehicle, rapid changes in $C_d$ can occur which are sensed by comparator 124 resulting in false and annoying sounding of the horn 72. The inhibit control 170 comprises a transistor amplifier which is conductive when the vehicle is in motion and the door is closed thus inhibiting an output of the alarm oscillator 70. However, as the vehicle stops, the door is opened and an activating voltage derived from switch 126 is applied via diode 128 of OR gate 61 to transistor 130 which cuts off transistor 170 thus enabling output of oscillator 150.

Rapid resetting of the bridge circuit can be accomplished through the use of a manual push button 160. The manual push button 160 enables the gate of the FET 122 via the transistor 130 thereby coupling the relatively short time constant $T_1$ into the integrator circuit.

The use of separate electrode assemblies 20 and 21 (FIG. 1) positioned at different locations about the vehicle is accompanied by the use of separate balanced bridge circuits, null amplifiers, synchronous detectors and comparators for use with each of the electrodes. The outputs of similar comparators 124 associated with different electrodes are used to activate a common indicator circuit.

A voltage regulator comprising a zener voltage reference source 154, an amplifier 156 and a transistor 158 is provided for establishing a regulated voltage for various circuits of the arrangement of FIG. 4. A sensitivity control comprising a potentiometer 162 is also provided and coupled to the integrator 118 for establishing a reference level for the integrator with respect to the output voltage level terminal 119 of the synchronous detector 56.

As described hereinbefore, the amplifier 108 (FIG. 4) drives the cable shield 112 and the guard electrode 26 of the electrode assembly. When the bridge circuit is balanced to a null, the voltage across the detector is at a minimum. If the reference side of the bridge is a low potential source, the shield of the sensor cable can be coupled to this point instead of to ground. This places the shunting capacitance of the cable across the detector input. A change in the cable capacitance due to variations in temperature or physical stress will not change the bridge balance but rather only the sensitivity of the detector. The guard electrode or shield 26 which is included in the electrode assembly 20 is positioned between the sensing electrode 22 and the floor or frame of the vehicle 10. This reduces the shunting capacitance across the sensing electrode. Material buildup such as dirt, mud, slush, ice, snow, etc. between the sensor assembly and the vehicle frame which would normally affect both the capacitive balance and the quadrature content of the signal due to the conductance of the material is reduced to a minimal amount. The stability of the system as well as the shaping of the electrostatic field in the desired area is thus enhanced.

Figures 5, 6:
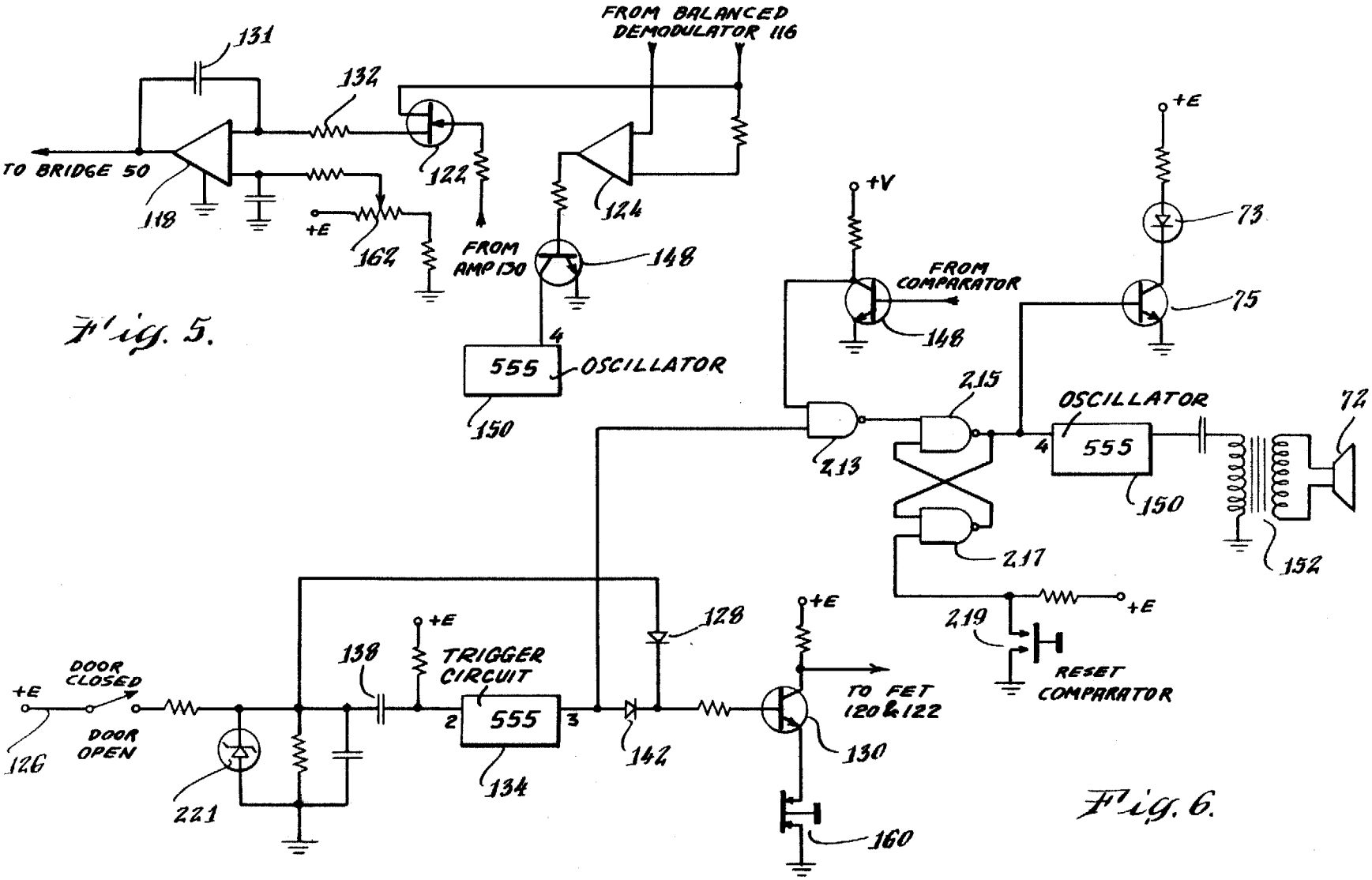
FIG. 5 is a schematic diagram of a part of the circuit arrangement of FIG. 4 and illustrates an alternative embodiment of the invention.
FIG. 6 is a schematic diagram of a part of the circuit arrangement of FIG. 4 and illustrates another alternative embodiment of the invention; and, FIG. 7 is an equivalent, simplified bridge circuit arrangement of FIG. 4.

In the embodiment of the invention illustrated in FIG. 4, the alarm indications are inhibited during vehicle motion and the bridge circuit is automatically rebalanced at the first relatively higher rate. When the vehicle stops and the door 68 is opened, rebalancing occurs at the second relatively lower rate, as indicated, and the alarm indications are enabled. FIG. 6 illustrates an alternative embodiment wherein the alarm indications are inhibited at all times except when the vehicle is stationary and the door has just been closed. This arrangement is advantageous in that it eliminates the need for the vehicle operator's attention to the indicator except in such times as when the door 68 is closed and the vehicle is preparing to proceed. A latch circuit is provided comprising NAND gates 213, 215 and 217. An output from the comparator 124 is applied via the enable transistor 148 to the NAND gate 213. Another input to the NAND gate 213 is an output from the delay multivibrator 134. As the door 68 is closed and the switch 126 is opened, the multivibrator 134 will be triggered and generate an output pulse having a period $T_4$. An input to the enable control transistor 148 upon door closure or during the succeeding interval $T_4$ will set the latch circuit to a condition for enabling the oscillator 150. The audible and visual alarm indicators will be energized and will remain active until the latch circuit is reset by reset push button switch 219.

The embodiment of FIG. 4 provides for varying rebalancing rate from its first relatively higher rate during vehicle motion to a second relatively lower rate when the vehicle stops. In accordance with other embodiments of the invention, when the vehicle stops, the rebalancing rate is varied by inhibiting rebalancing when the vehicle is stationary. FIG. 5 illustrates a circuit arrangement for effecting this mode of operation. In FIG. 5, the feedback control 60 comprises the single FET 122 which is controlled by the door switch 126. When the door switch 126 is opened, a potential is applied via diode 128 to the transistor 130 which cuts off the FET 122. During this interval, compensations for topography, circuit variations and the like which can cause a change $C_d$ will not cause a corresponding rebalancing of the bridge circuit and except for a relatively long time constant of the integrator circuit 118 itself (depending upon component leakage currents it is about 10 minutes), rebalancing of the bridge circuit is effectively inhibited. Closure of the door 68 will trigger the multivibrator 134 and generate a pulse having an interval $T_4$ which will continue to inhibit rebalancing of the bridge circuit for the interval $T_4$ after the door 68 is closed. At the end of the interval $T_4$, FET 122 will be enabled and will rebalance at the first relatively faster rate.

The arrangement of FIG. 5 is modified for maintaining the rebalancing rate at the first relatively higher rate after the vehicle becomes stationary when such mode of operation is preferred. In this mode of operation, the FET 122 will remain conductive except during the interval $T_4$ of the delay pulse generated by the multivibrator 134. This is accomplished by modifying the circuit of FIG. 5 by removing the diode 128. By removing the diode 128, a door opening no longer is effective to control the transistor 130 and thus the FET 122. However, closure of the door generates the pulse 136 (FIG. 4) which triggers the multivibrator 134 thus generating a delay pulse for the interval $T_4$ and cutting off the FET 122 during this interval. Since the diode 128 is removed from this arrangement, the transistor 130 will cut off the inhibit control transistor 170 only during the period $T_4$ of the delayed pulse generated by the multivibrator 134 and an alarm indication will be provided only during the delay interval. In the arrangement of FIG. 5 which includes the diode 128, the alarm indication will be provided both during that period when the vehicle is stationary and during the delay interval $T_4$.

The various parameters indicated herein are considered exemplary and are not deemed to be limiting. For example, the time constants $T_1$, $T_2$ and $T_3$ can be varied to satisfy particular requirements as can the interval $T_4$.

While the invention has been particularly described with respect to a school bus, it is equally useful with other forms of vehicles, some of which have been referred to herein.

An improved method and apparatus has been described for detecting the entry of an individual into a hazard area about a vehicle prior to placing the vehicle in motion. Upon detecting this presence, a sensory indication is provided to the vehicle operator. Alternatively, the indication may be used to disable movement of the vehicle. The arrangement is advantageous in that it reduces the susceptibility of the detector to variations caused by environmental conditions, enables the balanced bridge to be rapidly rebalanced and conditioned for sensing upon arrival at a location and senses the rapid entry of persons or objects into a hazard area while enabling subsequent compensations for other environmental changes and physical variations.

While there has been described particular embodiments of the invention, it will be apparent to those skilled in the art that variations may be made thereto without departing from the spirit of the invention and the scope of the appended claims.

What is claimed is:

1. A method for detecting the proximity of an individual to a vehicle, said vehicle having a detector including a balanced bridge circuit, said bridge circuit including a capacitor formed between earth ground and an electrode which is mounted to the exterior of the vehicle, the method comprising the steps are:

(a) establishing an electric field between the electrode and earth ground in an area exterior to the vehicle;

(b) automatically sensing bridge circuit unbalance and generating an electrical signal indicative of unbalance;

(c) rebalancing the bridge circuit upon occurrence of said signal at a first rate when the vehicle is in motion;

(d) varying, from the first rate, the rate at which the bridge circuit is rebalanced when the vehicle is stationary;

(e) detecting a change in a capacitance $C_d$ existing between the electrode and earth ground caused by the entry of a body into the field exterior to the vehicle when the vehicle is stationary;

(f) generating a sensory indication when the bridge circuit becomes unbalanced upon entry of a body into the external field when the vehicle is stationary; and, (g) restoring the rate of rebalancing of the bridge circuit to said first rate as the vehicle proceeds in motion.

2. The method of claim 1 wherein said bridge circuit rebalancing rate is varied to a second relatively lower rate when the vehicle is stationary.

3. The method of claim 1 where the bridge circuit rebalancing rate is inhibited when the vehicle is stationary.

4. The method of claim 2 including the step of inhibiting rebalancing at the second rate upon entry of a body into the electric field.

5. The method of claim 2 including the step of delaying restoration of the rebalancing of the bridge circuit to the first rate for an interval of time when the vehicle is stationary.

6. The method of claim 5 wherein said sensory indication is generated upon entry of a body into the electric field during the delay interval.

7. The method of claim 4 wherein restoration of the rebalancing rate to said second rate is provided upon departure of a body from the electric field.

8. The method of claim 5 including the step of causing the indication to be continuously generated only during the delay interval.

9. A proximity detector for detecting the presence of a person about the exterior of a vehicle comprising:

(a) an electrode mounted exterior to the vehicle and forming a capacitor having a capacitance $C_d$ with earth;

(b) a balanced bridge circuit including said capacitor;

(c) circuit means for exciting said bridge circuit and establishing an electric field exterior to the vehicle;

(d) circuit means responsive to the detection of an unbalance of the bridge circuit for rebalancing the bridge circuit at a first rate when the vehicle is in motion and for varying, from said first rate, the rate at which said bridge circuit is rebalanced when the vehicle is stationary;

(e) circuit means for detecting the entry of a body into said electric field when the vehicle is stationary; and, (f) circuit means for generating a sensory indication upon said entry.

10. The proximity detector of claim 9 wherein said rebalancing circuit means rebalances said bridge circuit at a second relatively lower rate when said vehicle is stationary.

11. The proximity detector of claim 10 including circuit means for inhibiting rebalancing of the bridge circuit at said second rate upon entry of a body into said field.

12. The proximity detector of claim 10 including means for restoring said balancing rate to said first rate upon vehicle motion and delay circuit means for delaying for an interval the rebalancing of the bridge circuit at said first rate.

13. The proximity detector of claim 12 including circuit means for enabling said sensory indication only during said delay interval.

14. The proximity detector of claim 10 wherein said circuit means for generating a sensory indication provides said indication only when the vehicle is stationary.

15. The proximity detector of claim 10 wherein rebalancing of the bridge circuit is inhibited when the vehicle is stationary.

16. An electrode assembly for a proximity detector for a vehicle comprising:

(a) an elongated support body formed of an electrically insulating material;

(b) a guard body having a semicircular cross sectional configuration and including an arcuate gap therein;

(c) an elongated electrode body mounted to said support body and positioned in said gap; and, (d) means for mounting said electrode assembly to a surface of the vehicle.

17. The electrode assembly of claim 16 including an insulating body positioned about said guard and electrode bodies.

18. The electrode assembly of claim 16 wherein the vehicle includes lower and side surfaces thereof and wherein said assembly is orientated for establishing an electric field in a space downwardly from the lower surface of said vehicle and outwardly from a side of said vehicle.

19. The method of claim 3 wherein said bridge is rebalanced at said first rate while said vehicle is stationary and said rate is varied during a delay interval by inhibiting rebalancing.

20. The method of claim 19 wherein said sensory indication is generated during said delay interval.

* * * * *